US005129318A

United States Patent [19]

Zimmer

[11] Patent Number: 5,129,318

[45] Date of Patent: Jul. 14, 1992

[54] REVOLVING RECYCLING COMPACTOR HAVING MULTIPLE CONTAINERS

[76] Inventor: John Zimmer, P.O. Box 9708, New Iberia, La. 70562-9708

[21] Appl. No.: 821,914

[22] Filed: Jan. 16, 1992

Related U.S. Application Data

[63] Continuation of Ser. No. 651,597, Feb. 6, 1991, abandoned, which is a continuation-in-part of Ser. No. 558,518, Jul. 27, 1990.

[51] Int. Cl.[5] ..... B30B 15/14; B30B 15/02; B30B 15/06

[52] U.S. Cl. ..... 100/53; 100/102; 100/137; 100/193; 100/221; 100/223; 100/229 A; 100/255; 100/269 R; 100/295

[58] Field of Search ..... 68/122, 124, 241; 100/43, 48, 53, 102, 137, 193, 209, 221, 223, 228, 229 A, 237, 240, 255, 269 R, 295

[56] References Cited

U.S. PATENT DOCUMENTS

| | | | |
|---|---|---|---|
| 3,680,478 | 8/1972 | Beachner, Jr. et al. | 100/229 A |
| 3,765,148 | 10/1973 | Ippolito et al. | 53/124 B |
| 3,808,967 | 5/1974 | Fair et al. | 100/221 |
| 4,241,652 | 12/1980 | Smedlund | 100/223 |
| 4,526,095 | 7/1985 | Rewitzer | 100/229 R |
| 4,685,391 | 8/1987 | Picker | 100/246 |
| 4,768,430 | 9/1988 | Yamamoto | 100/209 |

*Primary Examiner*—Harvey C. Hornsby
*Assistant Examiner*—Terrence R. Till
*Attorney, Agent, or Firm*—Pravel, Gambrell, Hewitt, Kimball & Krieger

[57] ABSTRACT

A refuse compacting system including a plurality of containers, each of the containers being substantially square and when placed in groups of four, forming four compacting stations, adjacent one another for occupying a reduced amount of space. In addition, the four containers would be set upon a manually rotatable platform, that would be rotatable upon a central axis for rotating the containers to a specific point when that particular container would be the point of compaction. The system would further include a single ram movable between a single preferably hydraulically operated ram movable between upper and lower positions, so that when a particular container removed directly beneath the ram, the turn-table would be manually placed in a stop position, and the ram moving to the down position in order to crush and containerize any waste materials in the container. There is further provided bag means contained in each of the containers, for allowing one to remove the compacted trash after the compaction is complete.

15 Claims, 10 Drawing Sheets

REVOLVING RECYCLING COMPACTOR HAVING MULTIPLE CONTAINERS

This is a continuation of Ser. No. 07/651,597 filed Feb. 6, 1991, now abandoned, which is a continuation-in-part of co-pending U.S. application, Ser. No. 07/558,518, filed on Jul. 27, 1990, "Revolving Recycling Compactor Having Multiple Containers", by the same inventor, presently pending hereby incorporated herein by reference.

BACKGROUND OF THE INVENTION

1. Field Of The Invention

The apparatus of the present invention relates to refuse compacting for recycling. More particularly, the present invention relates to a recycling compactor including multiple refuse containers, housed in a configuration for use within the confined area such as an oil rig, and allowing selective separation of types of refuse for compacting and recycling.

2. General Background

One of the continuous problems of work undertaken on an oil drilling rig or oil production platform is the problem of a limited amount of space in which to operate. As can be expected, in the enormous amount of work that takes place on such a rig or platform, waste is generated at a high rate, and there is an ever-pressing need for a system that can allow for the containerization of the waste and removal of the waste from the rig or platform for recycling. This process, of course, must be undertaken within a confined area, yet remove a great quantity of waste on a continuing basis.

A widely used system of eliminating and packaging waste everywhere, from the home to industry, is the use of trash compactors. Trash compacting, for example, on an oil rig or platform, is a very useful alternative in assuring that waste materials are confined to a reduced area, and can be hauled off within a container. However, waste materials resulting from oil exploration and production are quite varied, and range from quite hazardous materials to harmless materials such as glass or paper. Therefore, in striving to recycle the various components of refuse in this industry requires that the components be separated at their source, in order to begin the recycling process, and furthermore that each of the components after being separated be compacted in order to accommodate the various types of waste materials within the confined area such as an oil exploration and production platform. After the materials have been compacted as individual components of the refuse, the materials can then be easily removed from the area, and proceed further in the recycling process.

Several patents were found in the art which address the question of compacting in general, for example in multiple containers, the most pertinent being as follows:

| PATENT NO.: | PATENTEE: | TITLE: |
|---|---|---|
| 3,765,148 | Ippolito et al. | "Containers And Liners For Use In Compacting Systems Or The Like" |
| 4,526,095 | Rewitzer | "Process And Apparatus For The Automatic Depositing And Pressing Of Continuous Tows" |
| 3,726,211 | Gladwin | "Trash Compactor" |
| 3,680,478 | Beachner, Jr. et al. | "Refuse Container" |
| 2,984,957 | Lundgren | "Plant For Collecting Rubbish From Rubbish-Chutes In Open Containers" |
| 3,808,967 | Fair et al. | "Trash Compactor" |

SUMMARY OF THE PRESENT INVENTION

The system of the present invention solves the shortcomings in the art in a simple and straight forward manner. What is provided is a refuse compacting system including a plurality of containers, each of the containers being substantially square and when placed in groups of four, forming four compacting stations, adjacent one another for occupying a reduced amount of space. Furthermore, the four containers would be positioned, through welding or the like, upon a manually rotatable table that would rotate upon a central axis for moving the containers to a specific point when that particular container would be the container for compaction. The system would further include a dual or single hydraulically operated ram movable between upper and lower positions so that when a particular container is moved directly beneath the ram, the turn table would be manually placed in a stop position by means of a spring loaded foot pedal, and would remain at each container unless the foot pedal were held down. There would be further included a limit switch once a container is placed in position so that if the container were somehow moved during the compaction process, the limit switch would electronically interrupt the movement of the ram in the container. The ram would be activated to move to the down position electronically in order to crush and containerize any waste materials in the container.

There is further provided bag means contained in each of the containers, for allowing one to remove the compacted trash after the compaction is complete, which then can be continued in the recycling process. Further, there is included a means for allowing at least one of the walls of each of the container to hinge outwardly following compaction due to the fact that the material once compacted would be virtually impossible to remove due to the force on the walls of the container, and therefore the outward movement of one wall eases some of that pressure and allows the bag housing the compacted materials to be removed.

To address the problem of the bags being pushed down into the container as the ram is in operation, each of the bags contained on each of the containers is provided with a continuous draw string around its upper portion, so that as force is applied in the downward direction in the confines of the bag, the draw string attached to the outer portion of the container tends to pull the upper closure portion of the bag tightly around the outer edge of the container, thus helping to eliminate the problem of the bag being moved into the container inadvertently during compaction. These straps would later be utilized to serve as the lifting means for lifting the bag out of the container, and to form a closure on the bag which would be then tied in order to prevent materials from falling out of the bag, which is against EPA regulations.

Further, the present invention also provides that as an alternative to four square containers, the containers could be "pie" shaped, in order to provide a plurality of pie shaped containers on the table to allow for a greater number of compaction stations within the same table. The tables, in this particular embodiment, would be interchangeable so that either square or pie shaped containers could be utilized depending on the needs during compaction.

An additional principal embodiment would teach the use of multiple shape rams which would be used alternatively, for compacting materials which may be contained both in the pie-wedge shaped containers, or rectangular or other shape containers that the case may be.

Likewise, or course, the ram would have to be interchanged so as to configure to the shape of the particular type shape of containers used.

An additional embodiment would teach the use of multiple shaped rams which could be used in unison, for compacting materials which may be contained both in the pie-wedge shape containers, or rectangular or other shaped containers as the case may be.

Therefore, it is a primary object of the present invention to provide a compaction system for use on an exploration rig or production platform, which occupies a confined area of space;

It is still a principal object of the present invention to provide a compaction system which allows for multiple containers in the system that are confined within a certain area, and are movable on a central axis for compaction of each of the containers according to the rotation of the platform when the need is present;

It is still a further object of the present invention to provide a compaction system for oil rigs or production platforms, which utilize multiple containers so that various types of hazardous and non-hazardous waste and recyclable can be easily separated, and can occupy a limited amount of space and achieve compaction of multiple containers within that space;

It is a further object of the present invention to provide a compaction system for oil rigs or the like confined areas, which utilize a plurality of particular shaped containers that could compact a cubic foot area greater than the square footage of the area that would be occupied on the compaction table. This would be achieved by having a rotatable base, thus allowing clearance needed to unload one chamber without having to move the entire load, i.e., thirty (30) cubic feet from under the compaction ram, thus saving one half of the deck space normally required; and It is still a further object of the present invention to provide a compaction system for oil rigs or production platforms which utilize a plurality of substantially triangular shaped containers around the circumference of a circular platform, so that each of the triangular shaped container areas may be positioned beneath a similarly shaped ram, so that the ram may compact each of the areas and provide for a system of compacting multiple containers of various types of refuse materials depending on the particular need.

It is a further object of the present invention to provide a replaceable fabric bag insertable into a compaction container which has an upper end for constricting around the outer wall of the container during the compaction process so as to avoid the bag from being pulled into the container during that process.

BRIEF DESCRIPTION OF THE DRAWINGS

For a further understanding of the nature and objects of the present invention, reference should be had to the following detailed description taken in conjunction with the accompanying drawings, in which like parts are given like reference numerals, and wherein.

DETAILED DESCRIPTION OF THE PREFERRED EMBODIMENT

Figure 1:
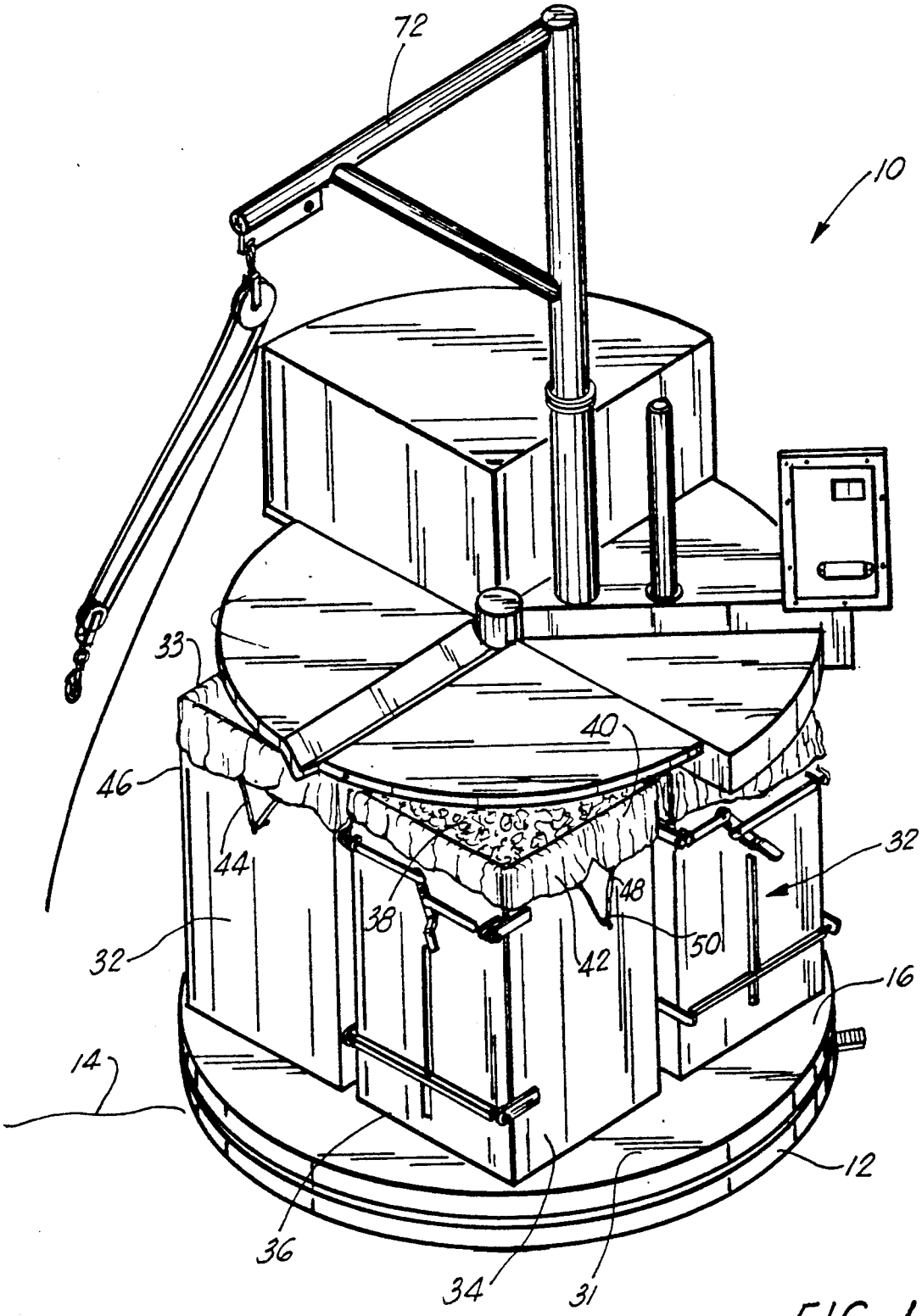
FIG. 1 is an overall perspective view of the preferred embodiment of the present invention.
Figure 2:
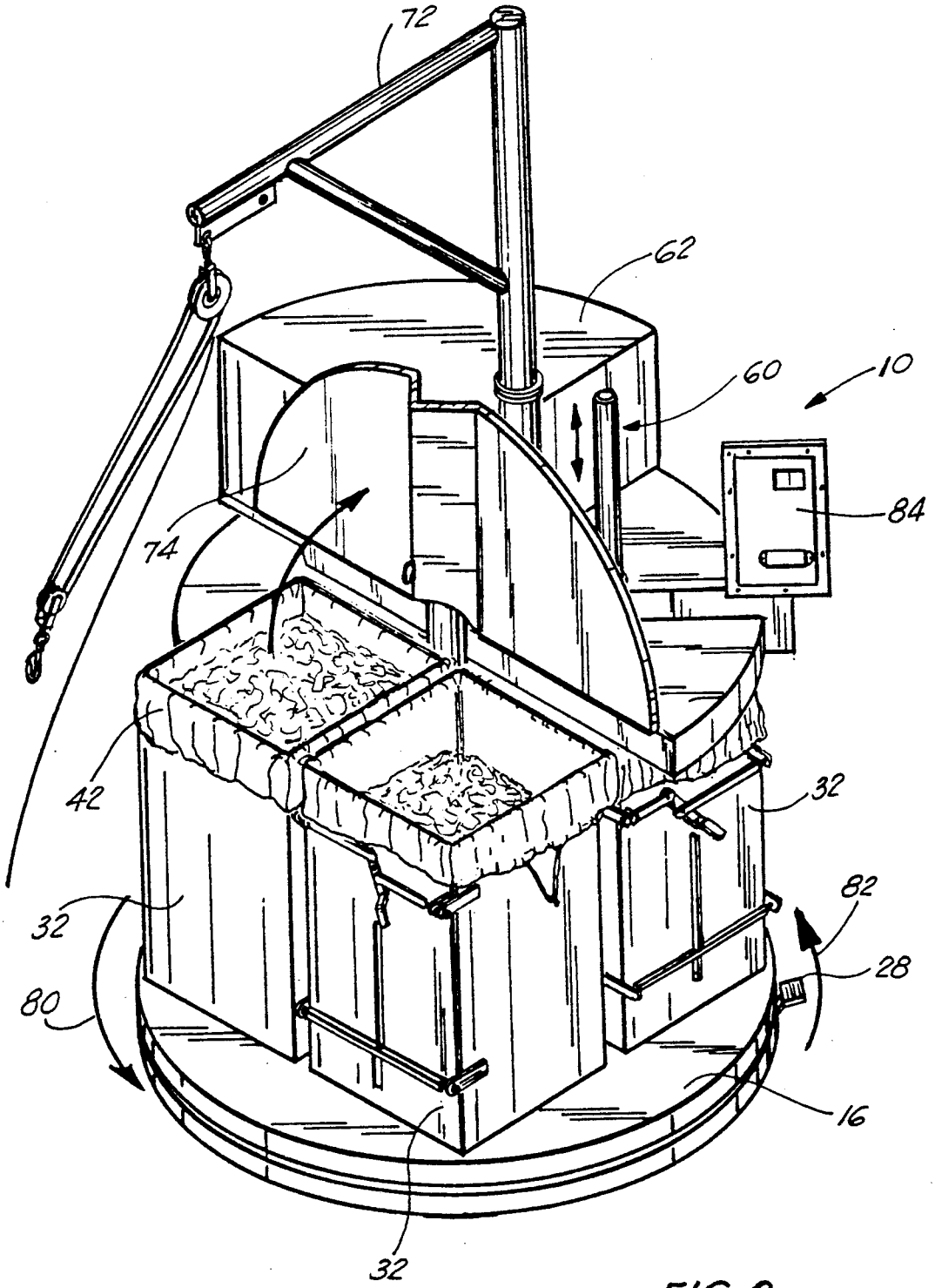
FIG. 2 is an overall perspective view of one embodiment of the present invention.
Figure 3:
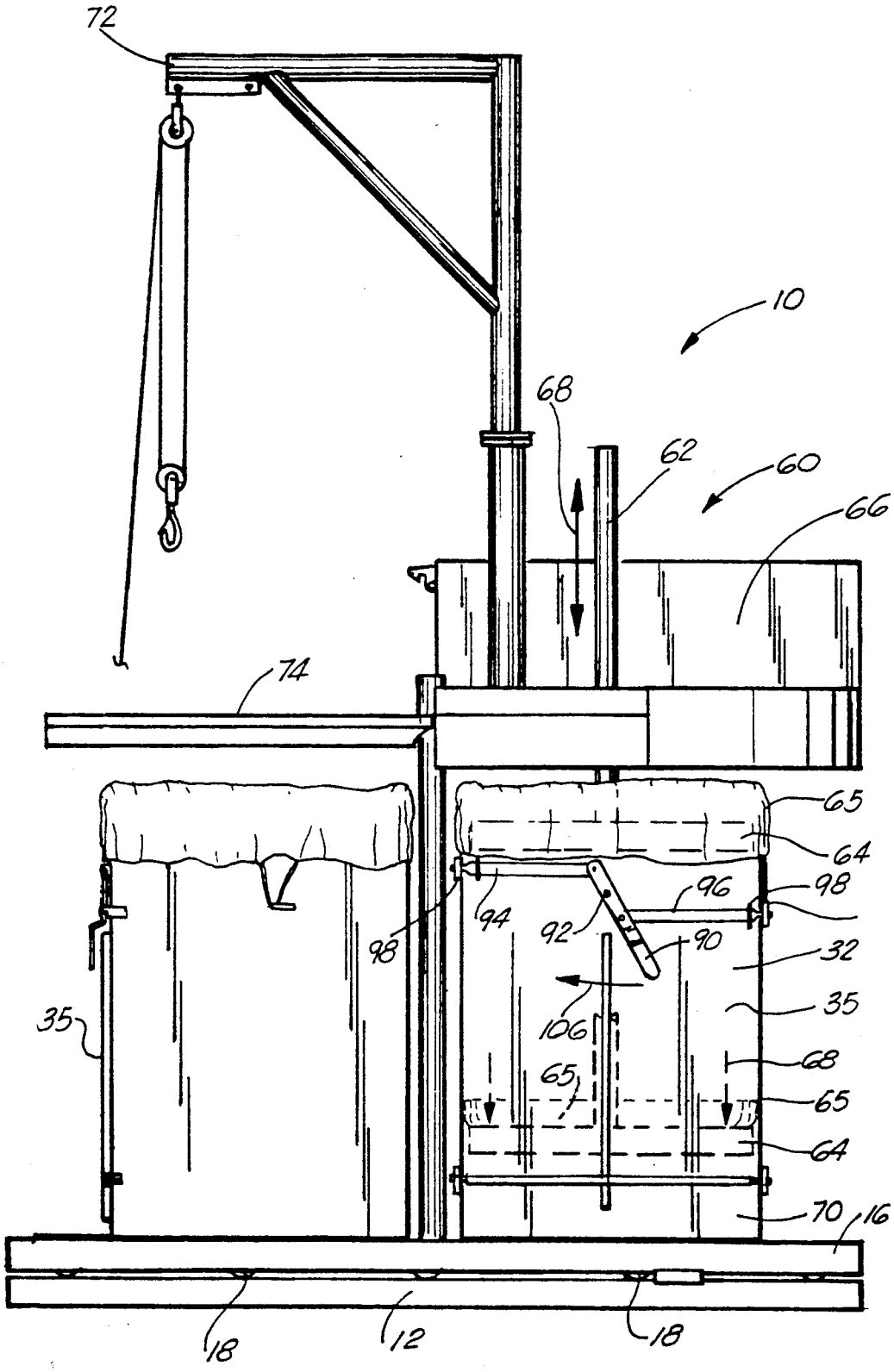
FIG. 3 is a side view of the first embodiment of the present invention.
Figure 4:
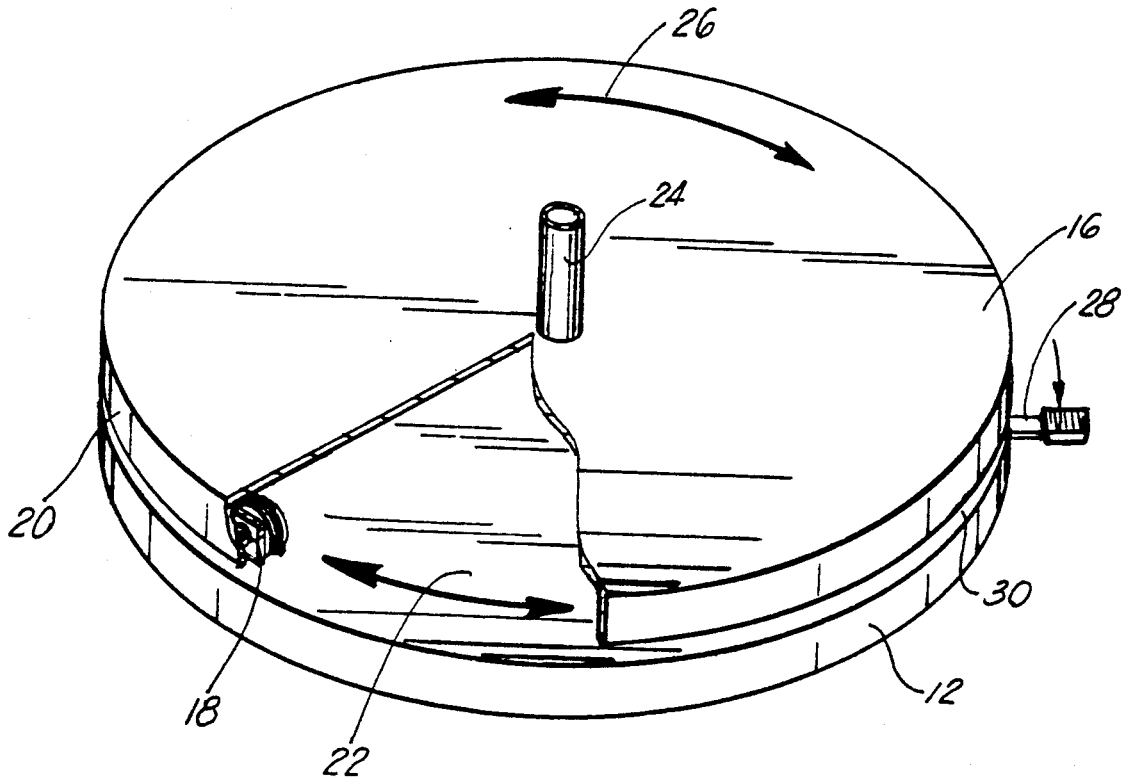
FIG. 4 is a partial view of the platform portion of the first preferred embodiment of present invention.
Figure 7:
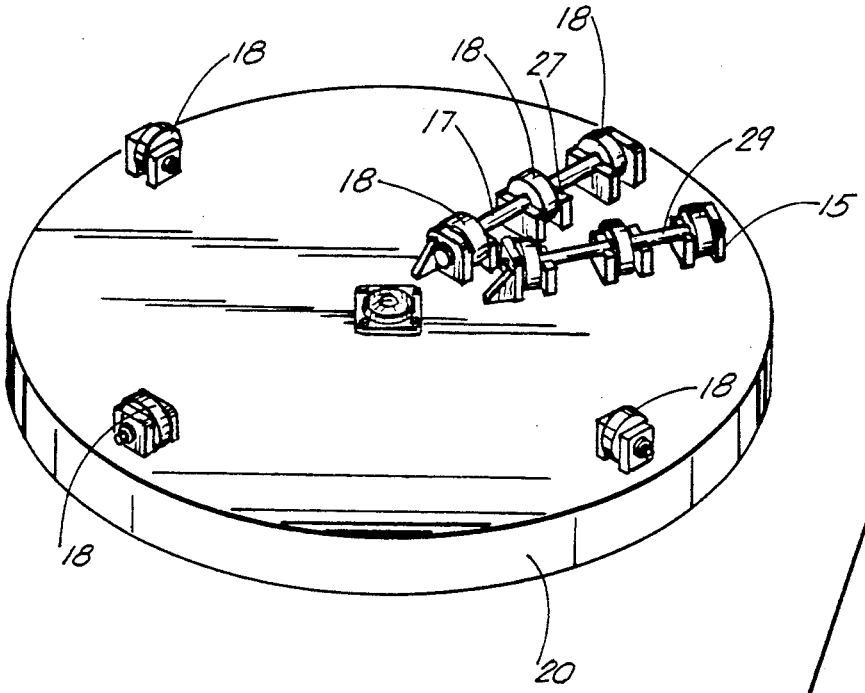
FIG. 7 is a partial view of the internal platform component in the preferred embodiment of the apparatus of the present invention as illustrated also in FIG. 4.

FIGS. 1 through 3 show the preferred embodiment of the apparatus of the present invention, designated by the numeral 10. As illustrated, apparatus 10 would comprise a circular base platform 12 that would be positioned in the floor 14 or the like, of an oil rig or production platform, in the preferred embodiment. Stationary circular platform 12 would be provided with a movable table 16 resting thereupon. As seen more clearly in FIGS. 4 and 7, circular table 16 would be rotatable upon stationary platform 12 via a plurality of rollers 18, spaced apart along its circular side wall 20 so that the rollers would make contact with the upper surface 22 of stationary platform 12 and would rotate there around, around the central axis 24 in either direction as indicated by Arrow 26. Furthermore, as illustrated in FIG. 7, there are a pair of roller assemblies 27, 29 which include a plurality of rollers 18 (3) positioned upon an axle 17, and intermediate bearing assemblies 15 with the pair of roller assemblies 27, 29 being positioned adjacent one another at the point directly below ramming arm 62 as it forces materials in the containers to be compacted. The assemblies 27, 29 are necessary to withstand the force of the compaction arm as it moves downward, in order to allow table 16 to be able to rotate freely and not to buckle under the weight of the force of the compaction.

There would be included a manually operated foot pedal 28, interposed in the space 30 between platform 12 and table 16, which would provide for a manual stop of the rotation of table 16, the reason of which will be discussed further.

Turning now to FIGS. 1 and 2, the system would further include a plurality of containers 32 positioned upon the upper surface 31 of table 16, each of the containers 32 including four side walls 34, of substantially equal width, thus forming a square container for each of the containers 32. Each of the containers would include a floor portion resting upon the upper surface 31 of table 16, and would be open ended at 38 on their top portion, the reason for which will be described further. Table 16 would be approximately ½ thick metal, so that it may withstand the compaction forces of the downward moving rams, and would not warp due to the heat generated when the containers 32 are welded to the floor portion 16 of the rotatable table.

As illustrated, the containers would be positioned upright on movable table 16, and would be substantially the height of a standard trash container for undertaking trash compaction.

It should be noted as illustrated in FIGS. 1 and 2, that each of the four containers 32 are positioned adjacent one another so that the four containers form a larger square area, and each of the containers 32 would occupy substantially a quadrant of that square. The four containers 32 as illustrated in position upon platform 16 would provide for a means to occupy a reduced amount of space upon a platform and yet have the ability, for example in this particular embodiment, to have a four container station for allowing the separation of refuse materials both hazardous and non-hazardous into four separate groups for further recycling.

Turning now to the compaction process itself, reference is made to FIG. 3, where it is illustrated that the compaction system 10 would further include a means for compacting the trash in each of the containers in the following manner. Compacting means 60 would include (as illustrated particularly in FIG. 3), a central shaft 62, guided by a ram guide (as seen in top view as 63 in FIGS. 9A and 9B), the central shaft 62, at its lower most end, being provided with a ramming member 64, having a substantially flat surface, and a three to four inch side wall surrounding the compaction surface, which would eliminate the possibility of the material being compacted from rolling between the side wall of the container and the flat surface of the ramming member, thus preventing the compacted material from being lifted up when the ram returns and eliminating the possibility that the ram may be jammed due to the material being trapped between the movable can and the fixed ram. It is foreseen, however, that the size of the ram would be slightly smaller than the size of the container, so as to allow a human hand to pass in the space should a hand be in the container at the time that the ram is moved downward. Instead of causing the pinching or smashing of the hand, one would be able to extract one's hand from the container in the space between the edge of the ram and the edge of the container.

Figure 5:
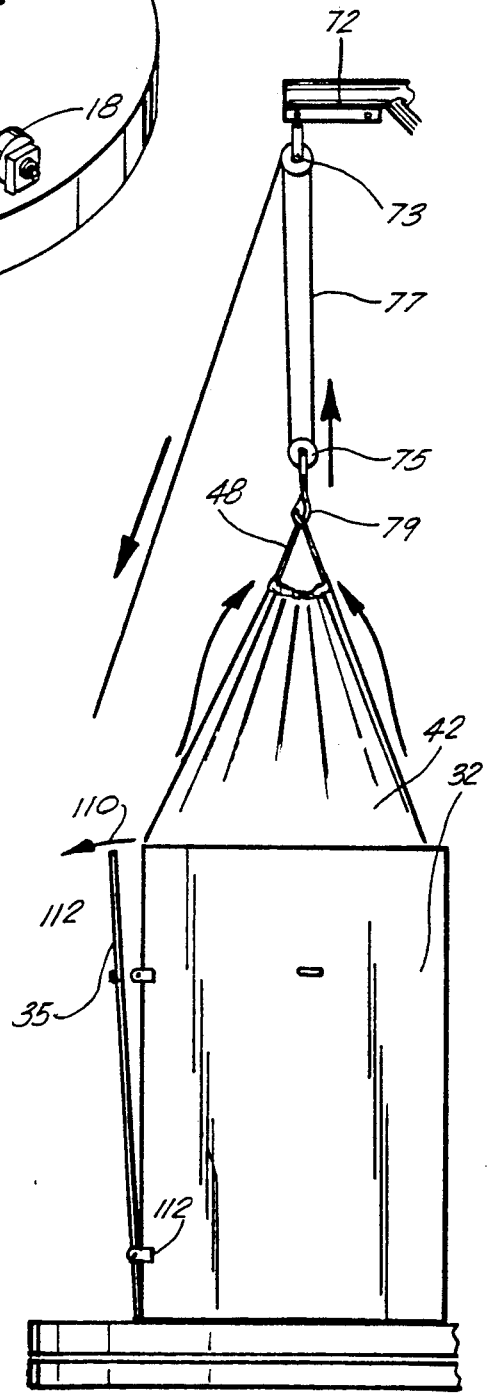
FIG. 5 is a partial view of the first preferred embodiment of the present invention illustrating the removal of a compacted refuse therefrom.

The ramming means 60 would be operated via a hydraulic system 66 (not illustrated), which would allow for the movement of the ram between the up position, as seen in full view in FIG. 3, and to the down position as seen in phantom view in FIG. 3 in the direction of Arrows 68. Of course, any refuse or the like contained within the container would be compacted from the entire space that it might occupy within the container 32 down to the confined space 70 beneath ram 64 as illustrated in FIG. 3. Following the compaction process, the bag would then be removed with the over head winch system 72, the process as illustrated in FIG. 5.

Although FIG. 3 simply shows the compaction of trash in a single container, this is but one facit of the operation. As was discussed earlier, and as illustrated in FIG. 2, each of the containers 32 would serve as a separate space in which different types of refuse can be compacted for purposes of safety or the like. For example, one container 32 may contain only glass, one container only metal, one container only non-hazardous soft-waste, and one container any hazardous waste. It should be noted that federal and state regulations stipulate that waste of this sort cannot be commingled and therefore must be handled in separate containers. Therefore, having the ability to have four containers positioned on the turn-table 16, allows for the manual separation of the waste to each of the containers. It should be noted as seen in FIG. 2, that there is a lid member 74 which would allow that when waste is being placed in the container the lid member 74 would be moved to the opened position, and after waste has been placed therein the lid member 74 is returned to the down position, as seen in FIG. 1, so as to prevent moisture such as rain or the like from entering the waste while it is being accumulated for future compaction.

As was stated earlier, one of the primary features of the system is the ability to compact waste in a plurality of different containers in the manner as illustrated. For example, in FIG. 3, the compaction process is on-going in a single container. After the ram 64 has moved to the up position, one would then manually release upper platform 16 via the foot pedal 28, and one could manually rotate the platform in either direction of Arrows 80, 82, until the next container was in position under ram 64 at which time the foot pedal 28 would reengage the stop means and the platform 16 would automatically stop in the proper position.

There is further provided a safety means with the use of a limit switch, which would prevent the container being compacted from being shifted out of position during the compaction process. If such were to occur, the limit switch would shut the system off, and the compaction would cease until the container returned to its rightful position. The electrical switching 84 could then be enacted so as to allow ram 64 to return to the compaction process, thus compacting the waste materials contained in the second container 32. This process would be repeated manually until all the containers which contained refuse would have the refuse compacted within the bag 42, and therefore there would be four different sets of trash compacted in the process.

When the bag 42 is filled with refuse, that has been compacted numerous times, there is a tendency for the bag 42 to expand a great deal within the confines of the space 38 within each of the containers 32. When the process of pulling the bag from the container 32, as illustrated in FIG. 5 is undertaken, bag 42 tends to be jammed within the container and the removal of the bag from the container containing the compacted trash is impossible within the container space. Therefore, there is included in the preferred embodiment a means for allowing that one of the exterior walls of the container, as illustrated in FIG. 5, is able to move outwardly at its upper portion, or in another embodiment, may be hinged along a vertical seam and allow it to swing open in order to free the bag.

When wall 35 is in the closed position, as illustrated in FIG. 3, while the trash is being compacted, there is included a means for maintaining the wall closed which is a latching member, that can be moved from the open position in order to allow the wall to hinge outwardly, to the closed position, as seen in FIG. 3, securing the wall flush against its adjacent walls. This latching member includes a handle portion 90, a pair of arm members 94, 96 and hinged at point 92 along wall 35. Each of the arm members 94 and 96 would latch into a latching bracket 98, at each ends of the wall, so that as handle member 90 is moved in the direction of Arrow 106, arms 94 and 96 are pulled inwardly and are unlatched and are therefore allowed the wall to hinge outwardly. When the bag has been removed, wall 35 is moved back into position, and arm 90 is moved back into its original position as seen in FIG. 3, and therefore, the arm members 94, 96 are latched and held in place as illustrated in FIG. 3.

As an additional latching means of latching the wall 35 closed, as illustrated in FIG. 3. It is noted that each of the forward wall portions 35 of each of the containers includes a means for releasing the wall from its closed position as seen in side view in FIG. 3. This means would include a latching member 90, hingedly attached to the wall portion 35, having a latching element 92, which would latch to a latching element 94 on the second wall of the container. Upon closing of the wall portion 35, the latching element would attach to the side wall and would be latched closed. This second manner of latching the wall member closed, is a quite simpler method than the method as seen in FIG. 3, and maybe the preferred manner of securing the wall 35 in the closed position.

An additional feature of the present invention is a feature which enables one to compact glass without the consequences of the glass particles or the like being released from the container as the glass is being compacted. This feature includes a flexible flap (as seen in phantom view) 65, which is attached to the ram plate 64, and would extend outwardly beyond the side wall of the ram 64. Therefore, as the ram 64 is moving into the container as seen in FIG. 3, the flexible material would be pushed back against the wall of the container and it will serve as a seal around the entire outer perimeter of the face of the ram as it moves downward into the container. Therefore, any glass or the like that may have a tendency to fly out of the container between the ram and the wall of the container would be kept in place via the flexible member 65.

Figure 8A:
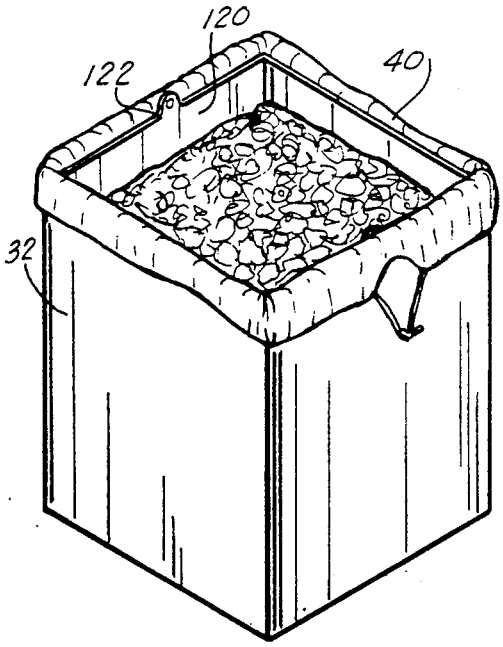
FIGS. 8A and 8B are views of a component of the preferred embodiment of the apparatus of the present invention utilized in the crushing of glass or the like material.
Figure 8B:
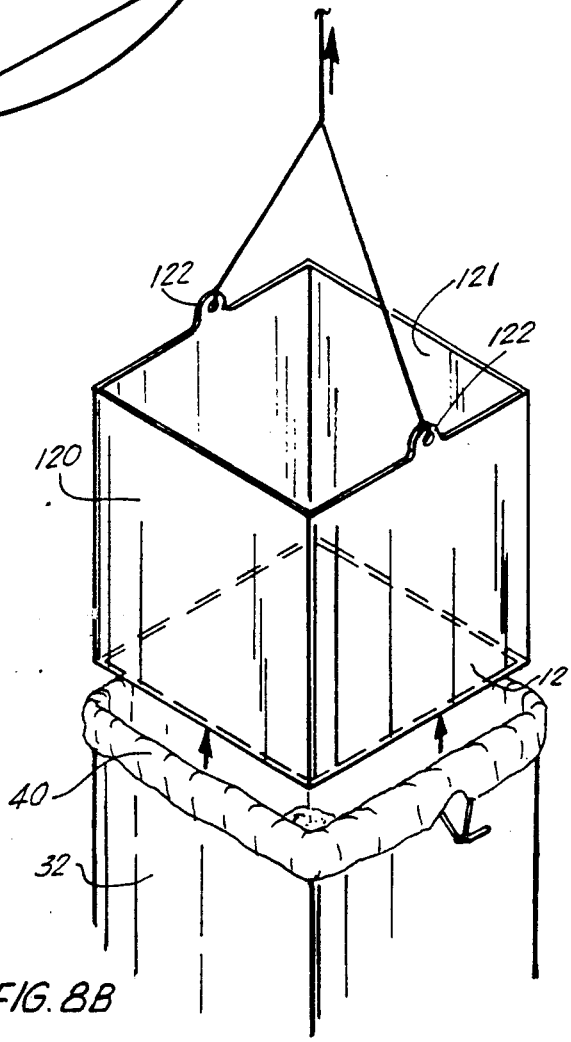

In addition, in order to solve the problem of glass which is being crushed from cutting into the fabric of the bag, and thus causing a rupture in the bag, reference is made to FIGS. 8A and 8B. In these Figures, there is included a means insertable into the fabric bag prior to the crushing of glass in a container. This means would comprise a multi-sided stainless steel insert 120, which would be configured in the shape of a particular container being utilized. The stainless steel insert would be open ended on its upper and lower ends 121 and 123, and would be slipped into the bag 40 after the bag has been set in place. Therefore, glass would be thrown into the interior of the jacket 120, and the ram would crush the glass contained within the stainless steel jacket 120. Following the compaction process, the stainless steel jacket 120, which would include handle members 122, would be pulled out of the bag, and the glass would then be maintained within the fabric bag 40. Therefore, during the compaction process, the glass being crushed or compacted would make contact only with the stainless steel jacket 120 and not with the fabric bag itself, other than the bottom of the bag 40.

Figure 6A:
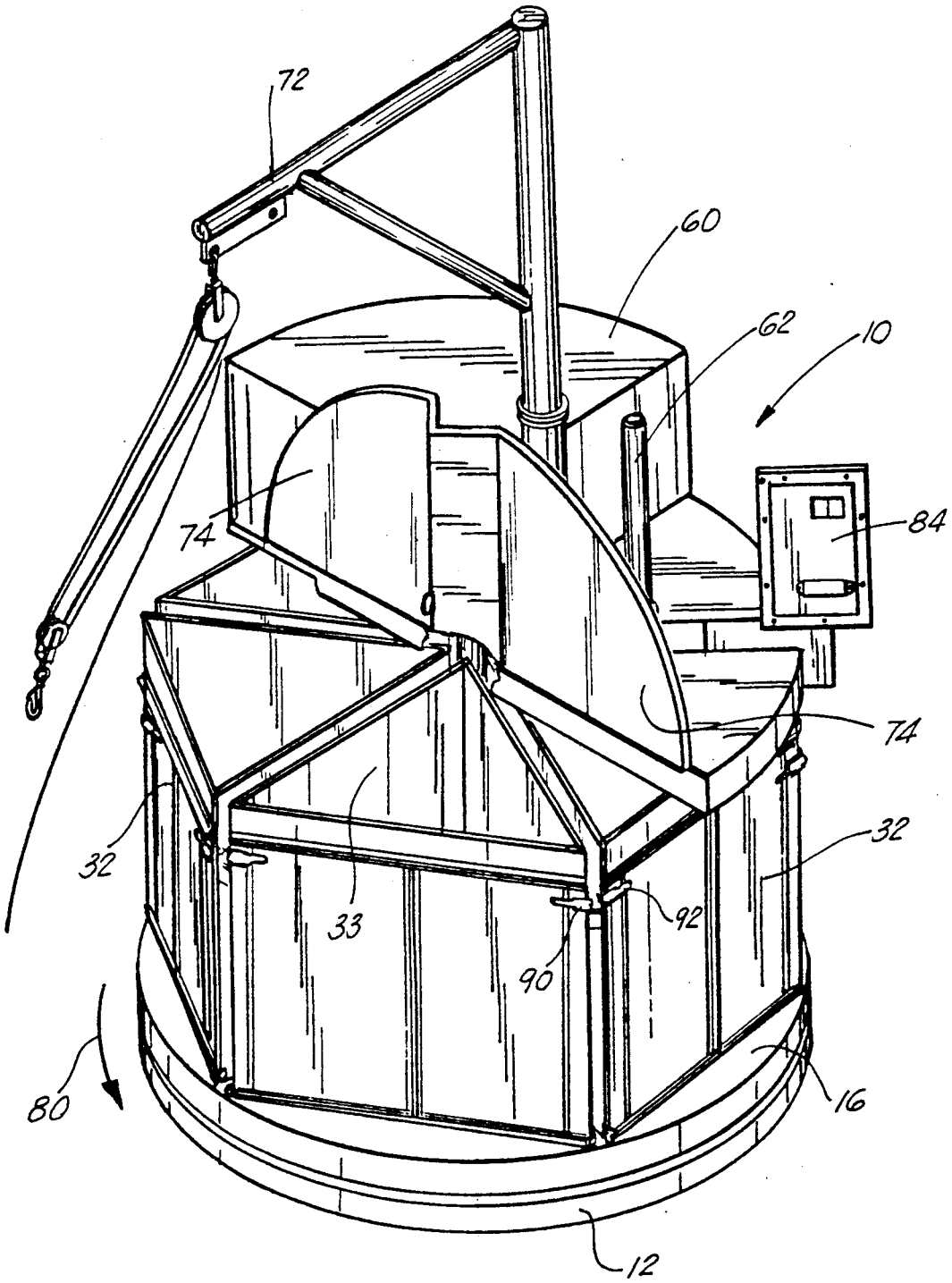
FIG. 6A is an overall perspective view of a second preferred embodiment of the system of the present invention.
Figure 6B:
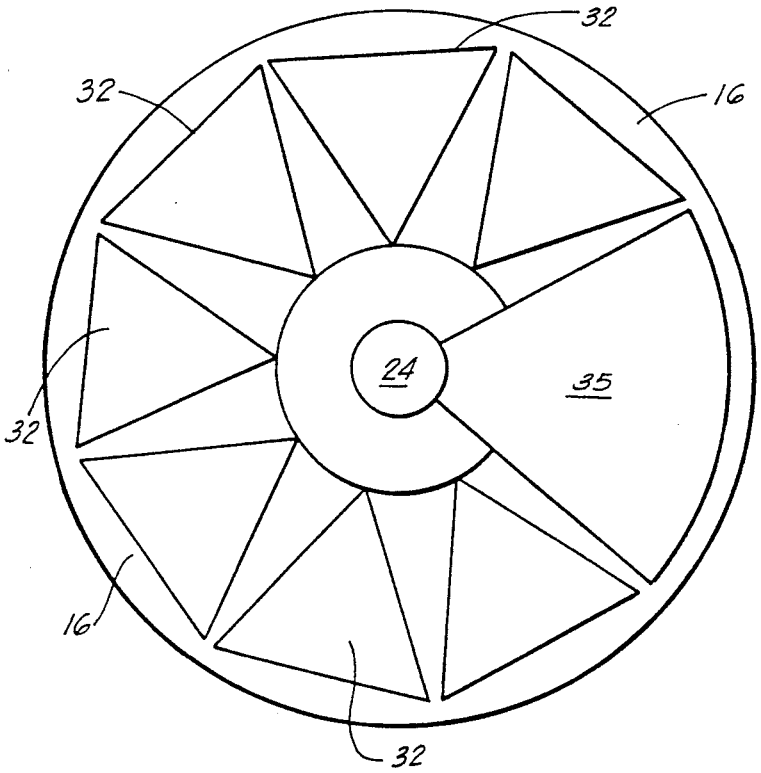
FIG. 6B is a top view of a modification of the second preferred embodiment of the apparatus of the present invention.

An additional embodiment is illustrated in FIG. 6. This particular embodiment of the system of the present invention addresses the need for a multiple compaction system that may yet provide a greater multiplicity of containers than is provided in the first preferred embodiment i.e., four containers. In this particular system, the movable table 16 placed upon stationary platform 12 would accommodate a plurality of containers 32 formed from a circular formation, with each of the containers 32 defining a triangulated or "pie-wedge" 33 part of the circle. Therefore, as seen, for example in FIG. 6, the circular container pattern has been divided into numerous separate pie-wedge container spaces 33, so that each of the container spaces 33 would be provided with a separate container bag 42, in the same manner as seen in the first preferred embodiment. Each of the bags would be secured in place in this similar fashion, and each would allow for the removal of the bag in a similar fashion, as in the first preferred embodiment. However, what is addressed in this system is the fact that whereas the first embodiment could only accommodate four containers, this embodiment may accommodate anywhere from four or more container spaces depending on the particular need of a customer for that particular system.

The only modification that would be absolutely necessary in this regard is the fact that the compaction member 64 would have to be similarly shaped to fit within the space of the particular size of each of the "pie-wedge" containers that would be utilized. It is foreseen that each of the compaction member 64 could be easily removed from the compaction arm 62, and could be replaced depending on the particular size of wedge that would be utilized in the system. Those number of "pie-wedge" spaces 33, as illustrated in FIG. 6, are simply representative of the configuration that is shown, but in no means would tend to limit the number of spaces that would be available. Therefore, in this particular embodiment, a customer is able to separate the waste into a numerous different types, and yet still operate within the confine space that was discussed earlier in the first preferred embodiment.

Further, as seen in FIG. 6, the table 16 would support a plurality of six equally shaped pie wedge containers 32, with a seventh pie wedge container 35 being of larger area. The six equally shaped containers would be utilized for various types of non-hazardous types of waste, and the larger pie shaped area would be utilized for, for example, hazardous waste materials and would be compacted in that greater quantity. Therefore, it is clear that the configuration of the containers are quite varied, and depending on the number and need of the particular system, a different combination of containers can be utilized within basically the same general area in the system.

For purposes of this particular step in the recycling of refuse, the compaction system may be provided with one or more rams in order to accommodate the refuse rather than the single ram that is disclosed primarily in the preferred embodiment. It is foreseen of course, that structurally the table housing the containers would have to be reinforced in the similar manner that the table is now reinforced to accommodate the second or third ram. The use of multiple rams, acting alternately, is discussed more thoroughly in FIGS. 9A and 9B.

As further illustrated, in FIGS. 8A–8C, each of the containers 32, as illustrated in 8A would be provided with a loop member 35 centrally positioned along each of the side walls 34 of each of the containers 32, and along the upper edge 33 thereof as illustrated in FIGS. 8A. Turning to FIG. 8B, there is illustrated an interior bag liner 40, which has been positioned within container 32, with the upper end 42 of bag liner 40 folded around the upper edge 33 of each of the containers 32, prior to placing refuse in the containers. Each of the bag portions 32 would include a continuous draw string 44 threaded through an upper channel 46 of the bag. There is further included four openings 49 in the channel 46 for providing access to four slack portions 48 in the draw string that may be pulled out of the channel 46 and secured in the loops 35 on the four side walls of the container as illustrated in FIG. 8B. At this point as illustrated in the FIGURE, bag liner 40 is still in the rather loose condition, since compacting has not begun.

Turning now to FIG. 8C, there is illustrated bag liner 40 with the ram member 64 moving downward into the container 32 in order to compact trash contained therein. At that point when the force is placed downward on the side walls of the bag 40, the upper edge 33 of the bag liner held in place by the drawstring loops 48 would then serve as a means for tightening around the upper edge of the container 32, thus preventing bag 40 from being pulled or sucked into the container as the compaction goes forward. This tightening of the upper end 33 of the bag 40 around the container 32 would prevent any problems of the bag being lost in the container, and when the compaction is completed, the drawstring 44 would then be utilized to remove the bag which would be tidily compacted into the container via the use of the overhead winch system 72. The bag would then be closed tightly with the use of the drawstring so that any of the compaction material within the bag would not fall from the bag when the material is being transported for further recycling.

Figure 9A:
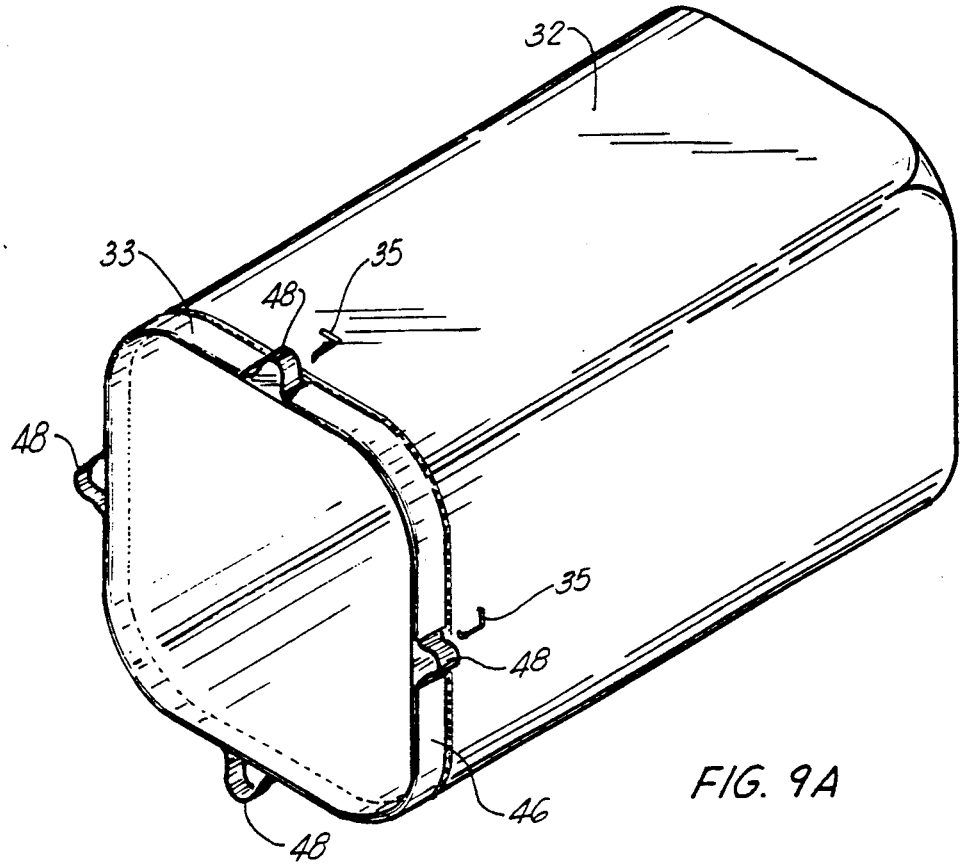
FIGS. 9A–9C are overall and side views of the replaceable fabric bag utilized in the containers in the preferred embodiment of the present invention.
Figure 9B:
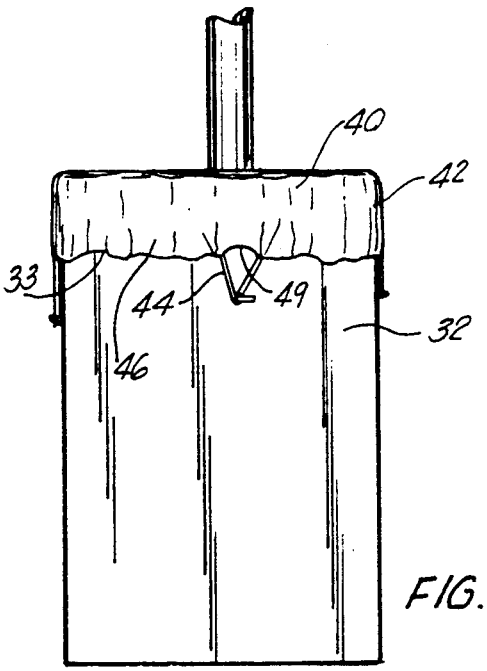
Figure 9C:
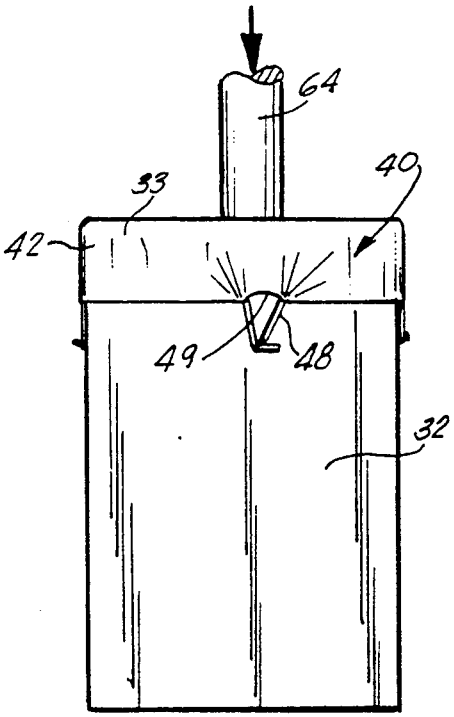
Figure 10A:
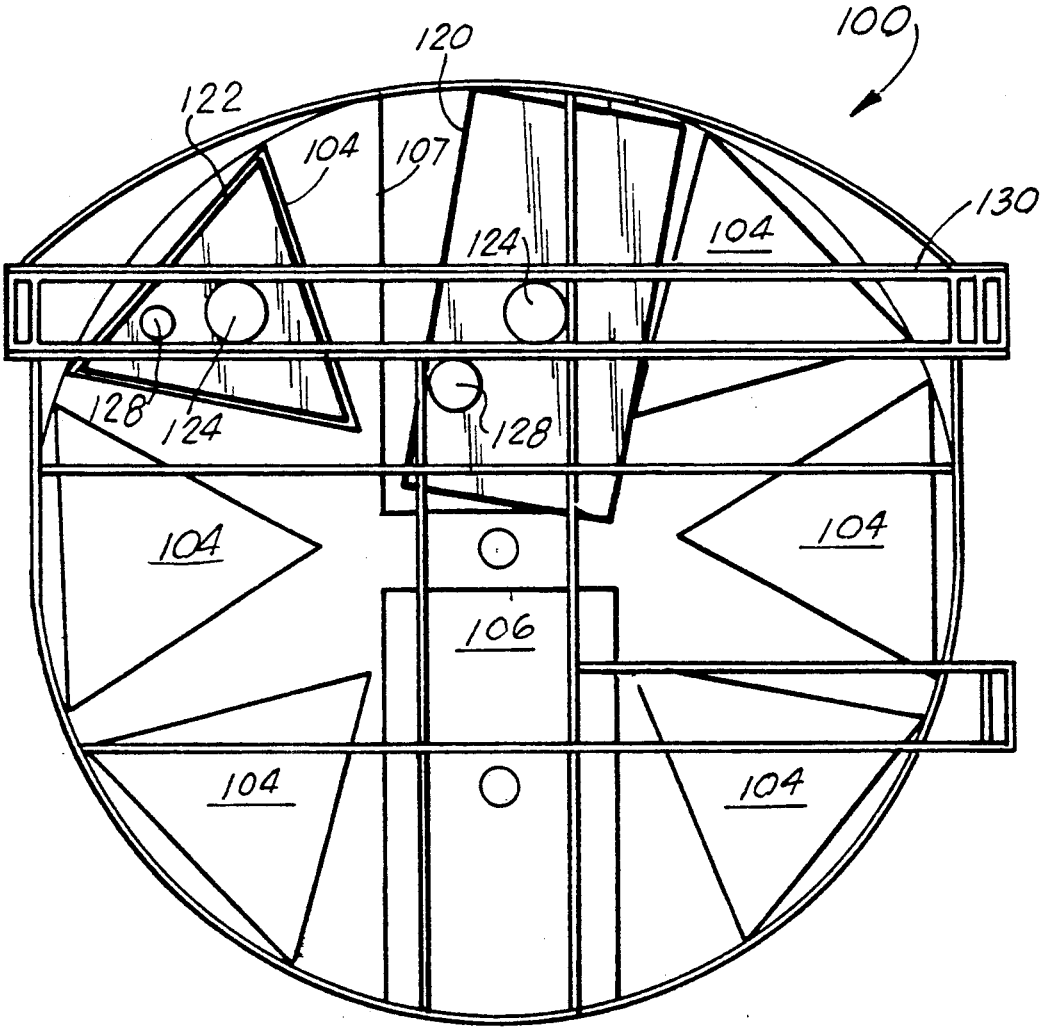
FIGS. 10A and 10B are top views of an additional embodiment illustrating containers of multiple shapes which may be utilized with multiple rams during the compaction process.
Figure 10B:
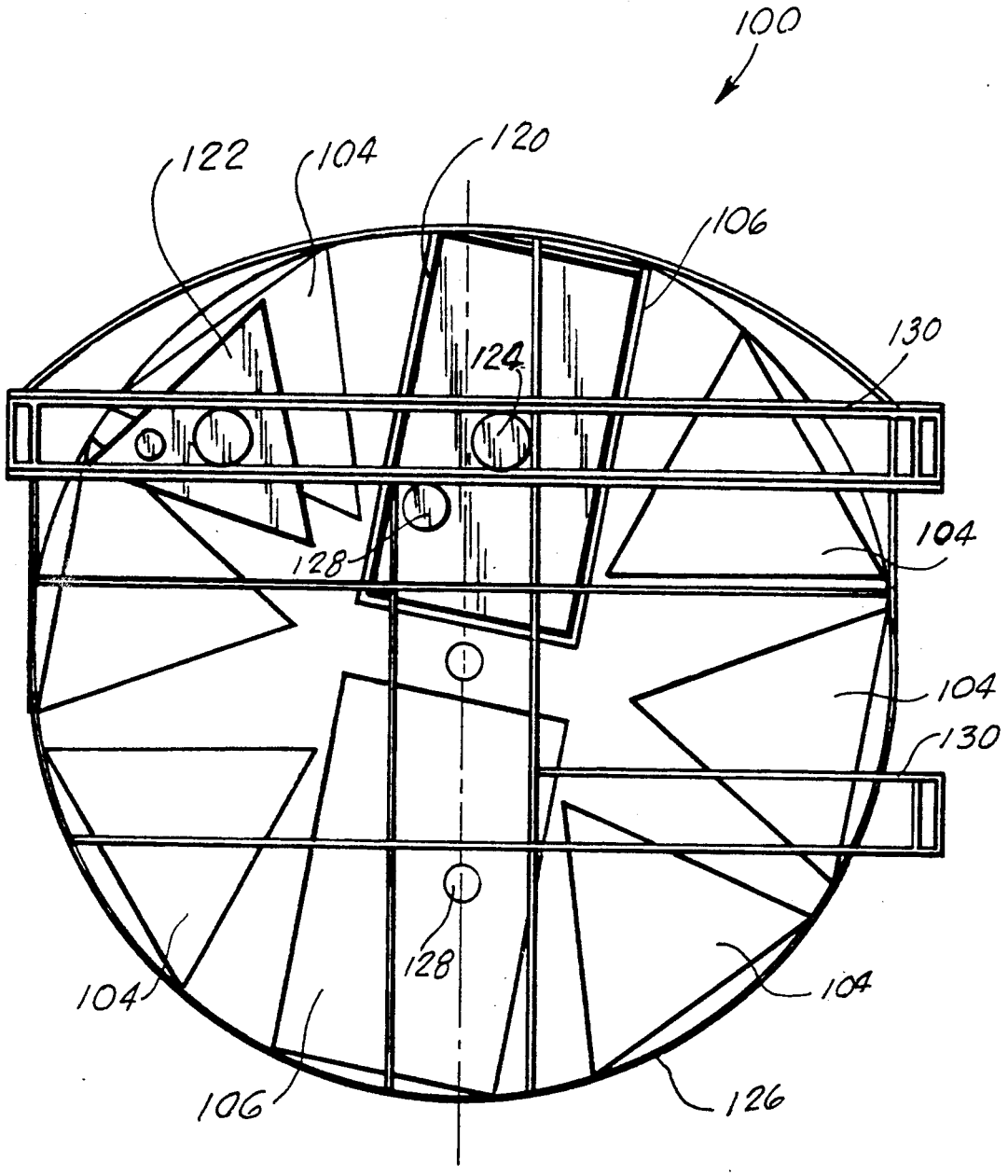

FIGS. 9A and 9B illustrate top views of an additional embodiment of the present invention of a multi-container compaction system by the numeral 100. In this particular embodiment, the compaction system is utilizing alternate rams in order to undertake the compaction process. As illustrated in the Figures, there is first included a rectangular ram 120, and a second pie wedge or triangular ram 122. As noted in the system in the top views in FIG. 9A and 9B, the system would include a plurality, or six, pie wedge containers 104 as illustrated and a pair of rectangular containers 106 as illustrated. The system would also include a platform 126, upon which these containers are positioned and held in place through welding or the like. As seen in top views, there is illustrated a primary ram support frame 130, extending substantially across the width of the platform 126, and is positioned substantially as seen in the embodiment illustrated in FIGS. 1 and 2. The difference in this particular embodiment is the fact that each of the rams 120, 122 contain a primary vertical shaft 124, with a guide shaft 128 which guides each of the rams 120, 122 as they move upwardly and downwardly during the compaction process, and helps to avoid the rams warping or being mis-aligned as they enter each of the containers during the compaction process.

One particular feature of this system lies in the fact this particular embodiment as seen in FIGS. 9A and 9B, illustrate an embodiment where dual rams, i.e., rectangular ram 120, and pie wedge ram 122, are acting on a single compaction platform or a station. Therefore, one is able to compact on one platform two different shaped containers rather than either have to interchange the rams as was discussed earlier, or have only a single ram. However, to afford that there is no danger involved in the use of multiple rams, reference is made to, first, for example FIG. 9A, where it is seen that pie wedge ram 122 is properly aligned to compact trash within container 104 and may be in the process of actually compacting the trash. However, so as to avoid any possibility of rectangular ram 120 compacting trash simultaneously, it is noted that rectangular ram is mis-aligned with the interior of rectangular container 106, and therefore could not possibly compact downward pass the upper edge 107 of container 106 should there be a malfunction. Likewise, as seen in FIG. 9B, when rectangular ram 120 is properly aligned within rectangular container 106, and is undertaking the compaction process, the triangular ram 122 is mis-aligned with triangular container 104, and therefore there is no possibility that triangular ram could compact inadvertently during the compaction process being undertaken in container 106. This particular feature therefore, while allowing dual rams to act alternatively, would not ever allow both rams to work simultaneously, in order to avoid any danger or possibility of injury to any workers having a dual simultaneously compaction acting system.

It should be noted that the rectangular containers 106 would serve a specific purpose in that due to their larger size than the pie wedge containers 104, they are able to accommodate larger boxes or the like. In order to facilitate faster and more convenient use of the large rectangular containers 106, there is foreseen that a door or the like could be placed to the rear of the unit adjacent to the large ram 120, which would enable the operator to place boxes or the like larger bulkier material directly into the container without the necessity of the rotation of the cans in order to have access to the larger container.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A refuse compaction system, utilizing multiple containers, the system comprising:

a) a circular table for placement of the multiple containers thereupon;

b) first ram means movable from a position above a first container, to a position for compacting material that may be contained in the first container;

c) a second alternate ram means moveable from a position above a second container, to a position for compacting material that may be contained in the second container;

d) means for rotating said table for positioning the first container beneath the first ram means when compacting material in the first container, and in the alternate, further positioning the second container beneath the second ram means when compacting refuse in the second container, so that when the first or second containers are positioned beneath each of their respective ram means, one of the ram means is misaligned with its respective container when the other ram means is directly above its respective container for compacting to prevent simultaneous compaction in each container; and e) a removable refuse bag, housed within each of the containers for removal therefrom after refuse contained therein has been compacted.

2. The system in claim 1, wherein positioning of the containers on the circular platform is in such a manner so as to provide for the multiple containers to occupy the space on the platform providing a greater cubic footage of compaction area than the square footage occupied by the containers themselves.

3. The system in claim 1, further comprising a second stationary platform upon which the rotatable table rotates about a central axis.

4. The system in claim 1, wherein the first ram means works independently of the second ram means, and each of the ram means would operate while the other ram means would be inoperative.

5. The system in claim 1, wherein the first and second ramming means are hydraulically operated.

6. The system in claim 1, wherein some of the multiple containers define triangular shaped containers and define rectangular shaped containers upon the circular platform.

7. The system in claim 1, further comprising means for easy removal of the bag contained within the multiple containers after the bag had been compacted with refuse.

8. The system in claim 1, further comprising means insertable into a fabric bag for preventing the contact of the material to the bag during the compaction of glass.

9. The system in claim 1, wherein the first ramming means is triangular shaped, and the second ramming means is rectangular shaped.

10. A refuse compaction system, utilizing multiple compaction containers, the system comprising:

a) a circular table for placement of the multiple containers thereupon;

b) each of the multiple containers configured to represent a predetermined portion of the circle, so that the containers as a whole define substantially the entire circular configuration on the platform;

c) first and second ram means, the first ram means having a triangular shape, and the second ram means having a rectangular shape, each of the ram means independently movable in the alternative, from a position above a similarly shaped container to a position for compacting that may be present in the container;

d) means for rotating said table for positioning the first container beneath the first ram means when compacting material in the first container, and in the alternate, further positioning the second container beneath the second ram means when compacting refuse in the second container, so that when the first or second containers are positioned below each of their respective ram means, one of the ram means is misaligned with its respective container when the other ram means is directly above its respective container for compacting to prevent simultaneous compaction in each container; and e) a removable refuse bag housed within each of the containers, further comprising means for maintaining the upper edge of the refuse badge tightly drawn around the upper edge of the containers where trash is being rammed into, so as to prevent the bag from slipping in the container during the ramming process.

11. The system in claim 10, wherein the ratio of the cubic footage of compaction area to the square footage of area occupied by the containers on the table is in substantially a two to one ratio.

12. The system in claim 10, further comprising a stainless steel jacket insertable into a refuse bag in one or more of the containers, so as to prevent any material from making contact with the wall of the bag should the material being compacted have the ability to cut into the wall of the bag.

13. The system in claim 10, wherein the circular table is positioned on a plurality of rollers set upon a immovable platform.

14. The system in claim 10, wherein the circular table is held in the immovable position with the use of a manually operated foot pedal and a central shaft rotating on a thrust bearing.

15. The system in claim 10, wherein there is further included means for allowing a wall of each of the containers to move outwardly in order to allow additional space for a bag filled with compacted material to be removed from the container.

* * * * *